United States Patent [19]

Jaeger

[11] 4,111,483

[45] Sep. 5, 1978

[54] DENTAL CHAIR HEADREST LOCKING DEVICE

[75] Inventor: Robert Charles Jaeger, Howell, N.J.

[73] Assignee: Pennwalt Corporation, Philadelphia, Pa.

[21] Appl. No.: 809,579

[22] Filed: Jun. 24, 1977

[51] Int. Cl.[2] ..... A47C 1/10

[52] U.S. Cl. ..... 297/410; 248/414

[58] Field of Search ..... 248/161, 410, 414; 297/410

[56] References Cited

U.S. PATENT DOCUMENTS

| | | | |
|---|---|---|---|
| 2,827,110 | 3/1958 | Rising | 297/410 X |
| 3,635,527 | 1/1972 | Weber | 297/410 |
| 3,642,321 | 2/1972 | Schwarz | 297/410 |
| 3,698,765 | 10/1972 | Olsen | 297/410 X |

*Primary Examiner*—James C. Mitchell

[57] ABSTRACT

A headrest mounted to the top of a dental chair backrest can readily be positioned by means of a headrest bar engaging a locking device affixed to the chair backrest. The locking device comprises a pair of resilient rubber surfaces which grip or contact the headrest bar to positively lock the headrest in position. By merely pushing the headrest to a more vertical position, the gripping or contacting of the rubber surfaces to the headrest bar is substantially eliminated to thus permit positioning of the headrest. Release of headrest will return it once again to a locked position.

7 Claims, 3 Drawing Figures

DENTAL CHAIR HEADREST LOCKING DEVICE

STATEMENT OF THE INVENTION

This invention relates to a dental chair and more particularly concerns improved means for positively locking the headrest thereof at a desired height or position.

BACKGROUND OF THE INVENTION

It is essential that the headrest, once adjusted to the proper position by the dentist, remain positively locked in that position while the patient is being worked on. It would be most disquieting to the patient and the dentist were this not so. Prior art headrest locking devices, in order to achieve an equivalent degree of positive locking, required critical and/or time-consuming adjustments, or employed metal to metal contact of moving parts which were unnecessarily noisy for the patient.

Accordingly, it is an object of the present invention to provide a positive means for locking a dental headrest in position.

Another object of the invention is to provide such positive locking means which are inexpensive, easy to manufacture, and very rapidly and quietly adjustable.

Still another object of the invention is to provide such positive locking means which are devoid of metal to metal contact of moving parts.

Other objects and a fuller understanding of the invention may be had by referring to the following description and claims taken in conjunction with the accompanying drawings.

DETAILED DESCRIPTION OF THE INVENTION

Figure 1:
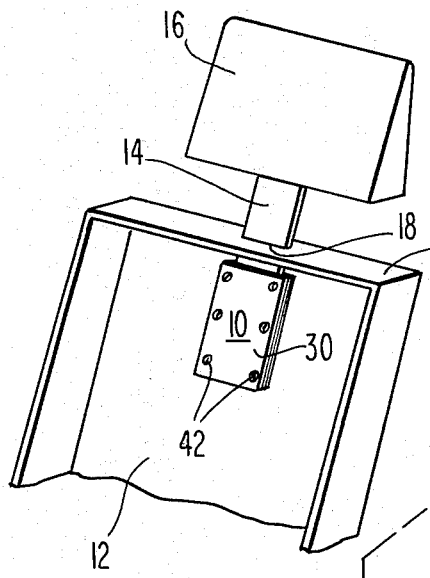
FIG. 1 illustrates my headrest locking device affixed to the back of a dental chair.

Referring to the drawings and more particularly to FIG. 1, thereof, there is shown my positive headrest locking device 10 affixed to back 12 of a dental chair. A headrest bar 14 extends from headrest 16 and passes through slot 18 disposed in an upper portion 20 of the chair backrest. By means of the bar 14 cooperating with locking device 10, the headrest may readily be positioned with respect to the chair backrest and positively locked at that position through the simple expediency of permitting the weight of the headrest itself to provide the necessary force to initiate the positive locking action, to be described more fully hereinafter.

Figure 2:
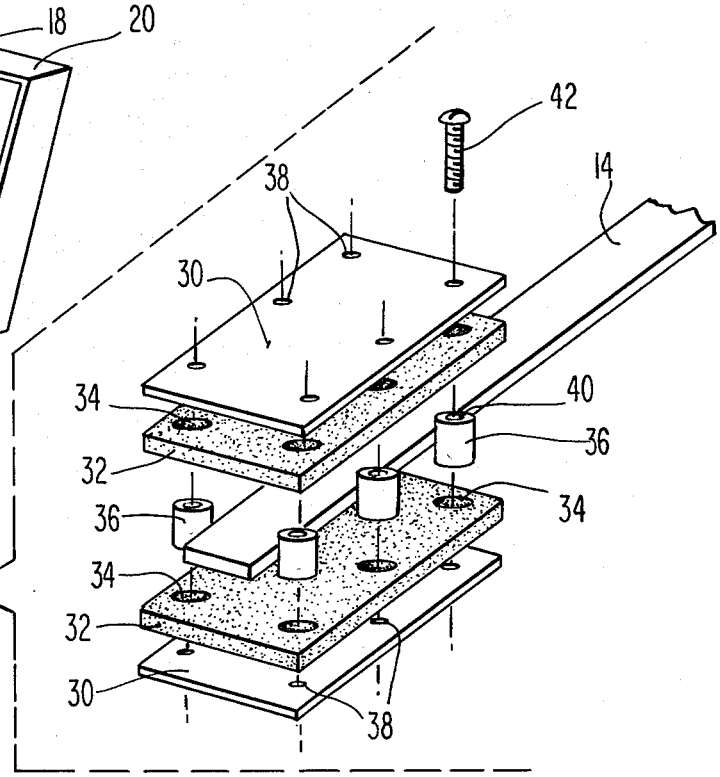
FIG. 2 is an exploded view of the locking device including the headrest bar operably engaged therein for adjustable movement therethrough.

Referring now to FIG. 2, the locking device comprises a pair of metallic plates 30, suitably of steel or aluminum, each having a rubber, or rubber-like pad 32 cemented to its inner face. The cement may be of any type suitable for this purpose. A plurality of uniformly spaced holes 34 are provided in the rubber pads, each receiving a spacer guide 36, suitably of nylon or polytetrafluoroethylene or similar low friction material. Metal plates 30 are similarly provided with holes 38, aligned with holes 34, but of a lesser diameter. It is preferred that the rubber pads have a durometer reading of between about 15 to 25. The holes 34 provided in the rubber pads should be just sufficiently large to receive the spacer guides, each of which is provided with a central orifice 40 for receiving a screw 42 for mounting the entire locking device to the dental chairback. The spacer guides will have a length which, when assembled into my locking device, will present an exposed area at their midportions just barely greater than the thickness of the headrest bar such that it may move axially of the locking device in either direction without substantial contact with the rubber pads. Thus, as clearly shown in FIG. 2, the spacer guides are intended to provide lock drag control to the headrest bar as well as controlling its side to side motion when the bar is in sliding engagement with the spacer guides. The locking device illustrated employs 6 spacer guides, the bar 14 slidably engaging each. The metallic plates provide rigidity to the device and means for adequately supporting the mounting screws 42.

Figure 3:
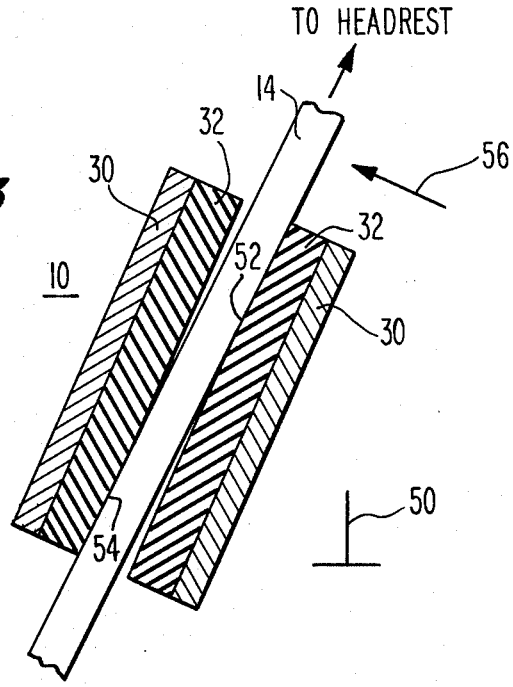
FIG. 3 is a longitudinal sectional view of my locking device showing the headrest bar locked in position.

Reference will now be made to FIG. 3 of the drawings wherein the locking device 10 is shown disposed at an angle away from the perpindicular, indicated by the numeral 50. Since the chair back and headrest will never be in a perpindicular operating position, the weight of the headrest alone will normally provide enough force for the bar 14 to engage or contact the rubber surfaces, the areas of contact shown generally at 52 and 54. Of course, with a patient's head on the headrest, an even greater force is exerted at points or areas 52 and 54, thus providing an even more positive locking arrangement. Now, by merely pushing the headrest in the direction of the arrow 56, the contacting surfaces between the bar 14 and rubber pads will be substantially eliminated to thus permit the dentist to raise or lower the headrest. As previously mentioned, the bar will easily slide along the low friction material spacer guides in either direction, but not from side to side. By varying the spacer height and rubber thickness with respect to the headrest bar thickness, as well as the compressive characteristics of the rubber used, the positive locking effect of my invention can be increased or decreased.

What is claimed is:

1. A dental chair adjustable headrest and locking mechanism therefor, said headrest comprising a head support member and said locking mechanism being affixed interiorly an upper central portion of a backrest of said chair, said backrest including an uppermost portion having a centrally disposed longitudinal slot therein, a substantially rectangular bar member having at least a pair of opposed flat surfaces, said bar member being disposed within said slot for axial movement therethrough and having one end permanently affixed to a lower central portion of said head support member and its other end cooperating with said locking mechanism, said locking mechanism comprising a pair of rigidly supported parallel pads of high friction material, said pair of rigidly supported parallel pads of high friction material consisting of a lower pad and an upper pad, said contact between said pads and said bar member resulting from force of gravity, said contact occurring at an upper portion of said lower pad and a lower portion of said upper pad, low friction spacer guide means disposed between said upper pad and said lower pad, said spacer guide means providing a space between said upper pad and said lower pad just barely greater than thickness of said bar member such that said bar member may move longitudinally of said locking mechanism without substantial contact with said upper pad and said lower pad, said low friction spacer guide means being so arranged as to exert drag control on said bar member to prevent gravitational downward movement of said head support member, said contact of said bar member with said upper portion of said lower pad and said lower portion of said upper pad being overcome when said head support member is pushed to a more vertical position whereby said headrest in adjustable within said locking mechanism.

2. The locking mechanism in accordance with claim 1 wherein a metallic plate is cemented to an outer flat surface of each of said pads to provide rigidity and support for said locking mechanism.

3. The locking mechanism in accordance with claim 2 wherein said high friction pads and metallic plates are provided with a plurality of holes therethrough, said holes in said pads and plates being aligned, said holes in said pads being of larger diameter than the holes of said plates, said low friction spacer guide means disposed into opposed holes of said pads, said spacer guide means having a diameter greater than the diameter of said holes in said plates, each of said spacer guide means providing an exposed portion for slidably engaging said bar member when said headrest member is caused to be moved towards or away from said chair backrest.

4. The locking mechanism in accordance with claim 3 wherein each of said spacer guide means is provided with an orifice centrally therethrough, and means for mounting said locking mechanism to said chair backrest.

5. The locking mechanism of claim 4 further characterized by said high friction pads being made of rubber having a durometer value of between about 15 to 25.

6. The locking mechanism of claim 4 further characterized by said spacer guide comprising a low friction material selected from the group consisting of nylon and polytetrafluoroethylene.

7. The locking mechanism of claim 4 further characterized by said mechanism being devoid of any metal to metal contact of moving parts.

* * * * *